US006320149B1

(12) United States Patent
Niemeyer

(10) Patent No.: US 6,320,149 B1
(45) Date of Patent: Nov. 20, 2001

(54) CURRENT CONTACT SYSTEM FOR A CURRENT SWITCH

(75) Inventor: Lutz Niemeyer, Birr (CH)

(73) Assignee: ABB Research Ltd., Zurich (CH)

( * ) Notice: Subject to any disclaimer, the term of this patent is extended or adjusted under 35 U.S.C. 154(b) by 0 days.

(21) Appl. No.: 09/743,138

(22) PCT Filed: Jul. 6, 1999

(86) PCT No.: PCT/CH99/00301

§ 371 Date: Apr. 18, 2001

§ 102(e) Date: Apr. 18, 2001

(87) PCT Pub. No.: WO00/03406

PCT Pub. Date: Jan. 20, 2000

(30) Foreign Application Priority Data

Jul. 7, 1998 (DE) ..... 198 30 232

(51) Int. Cl.[7] ..... H01H 33/20

(52) U.S. Cl. ..... 218/148; 218/118; 218/123

(58) Field of Search ..... 218/118, 120, 218/123–6, 140, 148, 154, 155, 43, 45, 46, 47, 48–50, 65, 74, 78, 84

(56) References Cited

U.S. PATENT DOCUMENTS

| | | | | |
|---|---|---|---|---|
| 1,942,678 | | 1/1934 | Austin . | |
| 5,844,189 | * | 12/1998 | Niemeyer | 218/43 |
| 6,107,590 | * | 8/2000 | Skindhoj et al. | 218/43 |

FOREIGN PATENT DOCUMENTS

| | | |
|---|---|---|
| 480164 | 7/1929 | (DE) . |
| 1921160 | 8/1970 | (DE) . |
| 2925162 | 12/1980 | (DE) . |
| 2925162C2 | 12/1980 | (DE) . |

* cited by examiner

*Primary Examiner*—Lincoln Donovan
(74) *Attorney, Agent, or Firm*—Burns, Doane, Swecker & Mathis, L.L.P.

(57) ABSTRACT

A moving first electrical contact arrangement (K1) has a switching contact (P4) and a U-shaped arcing horn (R1) on the end face. A stationary second electrical contact arrangement (K2) has a switching contact (P1) and a U-shaped electrical conductor loop (R2) on the end face. The electrical conductor loop (R2) is composed in its U-shaped part, of a bimetallic strip, composed of steel (2) on the inside and copper (3) on the outside; two mutually opposite switching contacts (P2, P3) are provided adjacent to this, and an arcing horn (3') is provided on the end face. When the electrical switch is closed, the first electrical contact arrangement (K1) is moved to the left in the opposite direction to an arrow (5), so that all four switching contacts (P1)–(P4) make a pressure contact with one another. When the electrical switch is opened, the contact pairs (P1, P2) are disconnected first, as a result of which a current (4) is commutated from them into the electrical conductor loop (R2) as is shown by a dashed line. Once the stress on the electrical conductor loop (R2) has been relieved, the contact pair (P3, P4) is also disconnected, so that an arc (6) is struck, which is driven onto the arcing horns (3', R1) by the asymmetric current routing in the electrical conductor loop (R2). The arc is thus quickly driven away from its original contact point and, in the process, is increasingly asymmetrically blown magnetically, so that its burning voltage rapidly increases. This simple contact structure, which can be produced economically, ensures a low rate of wear.

6 Claims, 1 Drawing Sheet

CURRENT CONTACT SYSTEM FOR A CURRENT SWITCH

BACKGROUND ART

In the precharacterizing clause of patent claim 1, the invention refers to a prior art as is known from DE 2925162 C2. This describes a high-voltage switch with a moving switching piece between an inner and an outer stationary switching piece. A contact finger is inserted into the outer switching piece and has a contact loop fitted with a leaf-spring which presses against a contact ring on the moving switching piece of the electrical switch when said switch is in the closed state. A loop-type contact is arranged on the moving switching piece and presses against the inner switching piece when the electrical switch is in the closed state, and opens after the contact finger has opened when the electrical switch is opening. During the disconnection process, a comparatively high voltage builds up in a very short time between the rated electrical contacts, and this extremely rapidly drives the current to be disconnected, from the rated current path into a power path. The arc which is struck when the contact finger contact opens is blown by the loop of the magnetic field; it is extinguished quickly since, initially, there is still an alternative current path between the moving switching piece and the inner, stationary switching piece.

The construction of such a rated current contact system with a large number of contact fingers and associated holders and contact-pressure springs is relatively complex and expensive.

SUMMARY OF THE INVENTION

The invention, as it is defined in patent claim 1, achieves the object of further developing electrical contact arrangements in an electrical switch of the type mentioned initially in such a way that the electrical switch can be produced more easily and more cost-effectively.

Advantageous refinements of the invention are defined in the dependent patent claims.

One advantage of the invention is that no additional power current path is required to supplement the rated current path.

According to one advantageous refinement of the invention, it is possible, using simple means, to enlarge the arc length and thus to increase the commutation voltage, to improve the disconnection response, and to reduce the wear to the electrical contacts.

BRIEF DESCRIPTION OF THE DRAWINGS

The invention will be explained in the following text with reference to an exemplary embodiment. In the figures.

Figure 1:
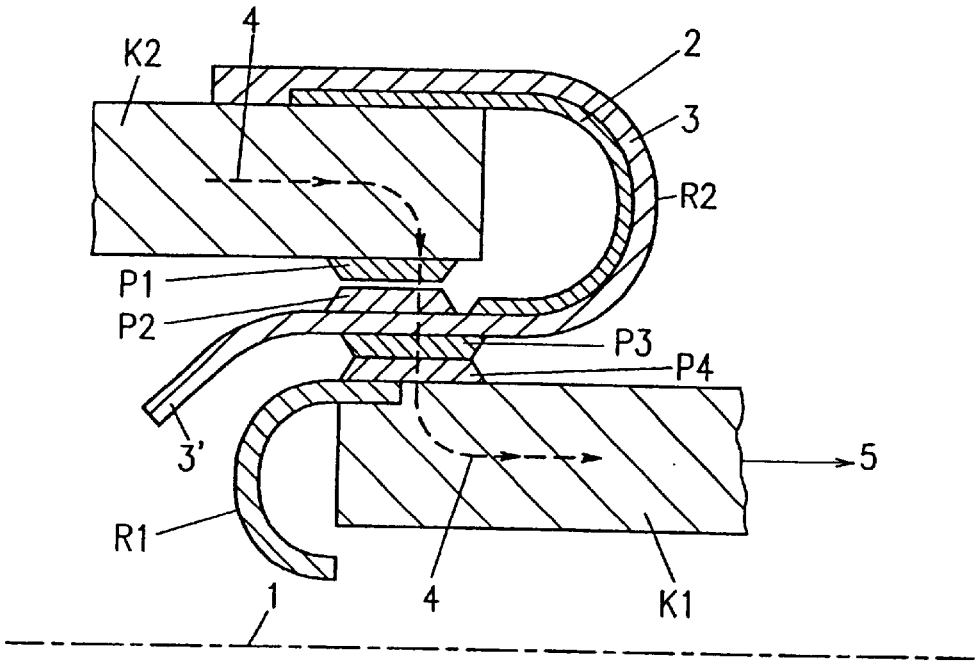
FIG. 1 shows a detail of a cross section of the upper half of the electrical contact arrangements in an electrical switch in a closed position.

Physical elements which are not required for understanding of the invention, as well as the housing of the electrical switch, have been omitted in the drawings. For the sake of clarity, parts which are shown as being integral can, in practice, be composed of a number of parts, for design and production reasons.

DESCRIPTION OF THE PREFERRED EMBODIMENTS

Identical parts are denoted by identical reference symbols in the figures. FIG. 1 shows a detail of a cross section of a circular-cylindrical rated-current contact arrangement of a circuit breaker or electrical switch in the closed state, with (1) denoting its longitudinal axis. A tubular, moving first electrical contact arrangement (K1) and a tubular, stationary second electrical contact arrangement (K2) have switching contacts (P4) and (P1), respectively, on the end face, which contacts can be produced cost-effectively by welding on profiled rings. Furthermore, a U-shaped arcing horn (R1) composed of an electrically highly conductive material is arranged on the end face of the first electrical contact arrangement (K1), and an arcing horn or a U-shaped electrical conductor loop (R2), which consists of a bimetallic strip up to mutually opposite switching contacts (P2) and (P3), is arranged on the end face of the second electrical contact arrangement (K2). The inner part of the bimetallic strip is composed of a material having a high modulus of elasticity, preferably of steel (2), and the outer part is composed of an electrically highly conductive material, preferably of copper (3) or of a copper alloy. The steel component of the electrical conductor loop (R2) ensures that it has high radial elasticity; it is shaped such that the electrical conductor loop (R2) relaxes into the shape shown in FIG. 2, after contact disconnection. In order to improve this elasticity, the electrical conductor loop (R2) may be sawn into in a radial direction on its face which is bent inwards. The copper component of the bimetallic strip ensures high electrical conductivity. The switching contacts (P1)–(P4), which are located one above the other when the electrical switch is in the closed state and are pressed into contact by elastic deformation of the first and second electrical contact arrangements (K1, K2), are stressed to different levels by arcs. A silver coating is sufficient for the lightly stressed switching contacts (P1) and (P2), while the switching contacts (P3) and (P4) have a coating composed of a consumable material. On the end face behind the switching contacts (P1) and (P2), the electrical conductor loop (R2) has a contact end or arcing horn (3') which is composed of copper and is bent away on the arcing side. A dashed line (4) through the first electrical contact arrangement (K1), the switching contacts (P1)–(P4) and the second electrical contact arrangement (K2) indicates a symmetrical current path.

Figure 2:
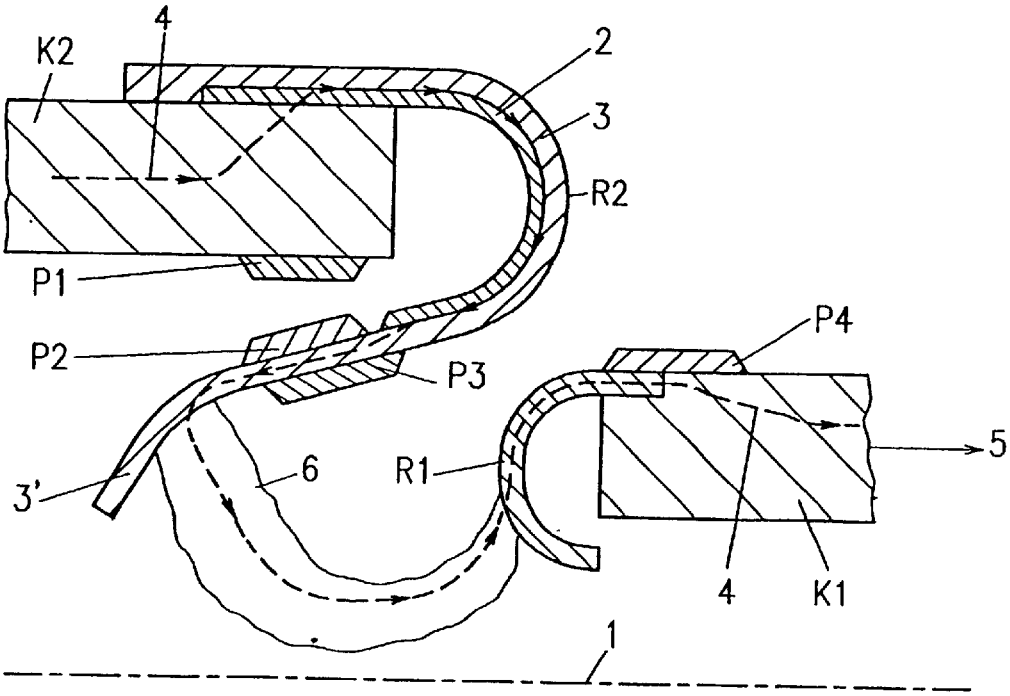
FIG. 2 shows electrical contact arrangements as shown in FIG. 1, in the open switching state.

FIG. 2 shows electrical contact arrangements in the electrical switch as shown in FIG. 1 in the open state, with the first electrical contact arrangement (K1) having been moved to the right in the direction of the arrow (5). During the opening process, the contact pairs (P1, P2) are disconnected first of all, as a result of which the current commutates into the electrical conductor loop (R2), as is shown by a dashed line. Once the electrical conductor loop (R2) has been relieved of stress, the contact pair (P3, P4) is also disconnected, so that an arc (6) is struck, which is driven onto the arcing horns (3', R1) by the asymmetric current routing in the electrical conductor loop (R2). The arc is thus quickly driven away from the original contact point and, in the process, is increasingly blown asymmetrically magnetically, so that its burning voltage rapidly increases.

LIST OF DESIGNATIONS

| | |
|---|---|
| 1 | Longitudinal axis of the electrical switch |
| 2 | First bimetallic element of R2, steel |
| 3 | Second bimetallic element of R2, copper |
| 3' | Arc-side contact end of 3, horn bracket, arcing horn |
| 4 | Current path |
| 5 | Arrow |

-continued

| LIST OF DESIGNATIONS | |
|---|---|
| 6 | Arc |
| K1 | Moving first electrical contact arrangement |
| K2 | Stationary second electrical contact arrangement |
| P1 | Switching contact of K2 |
| P2, P3 | Switching contacts of R2 |
| P4 | Switching contact of K1 |
| R1 | U-shaped arcing horn of K1 |
| R2 | U-shaped electrical conductor loop of K2, arcing horn |

What is claimed is:

1. Electrical contact arrangements in an electrical switch a) having at least two first and second electrical contact arrangements which can be moved mechanically with respect to one another, b) in which each of these electrical contact arrangements has at least one switching contact, and c) in which at least one of the two electrical contact arrangements has an electrical conductor loop, characterized d) in that the electrical conductor loop has at least two switching contacts, and e) in that these switching contacts for the electrical conductor loop make a highly conductive, mechanical compression joint with the switching contacts of the two electrical contact arrangements when the electrical switch is in the closed state.

2. The electrical contact arrangements as claimed in claim 1, characterized in that the electrical conductor loop is designed to be elastic.

3. The electrical contact arrangements as claimed in claim 1, characterized in that the electrical conductor loop is in the form of a bimetallic strip, the inside being composed of a material having a high modulus of elasticity, and on the outside being composed of an electrically highly conductive material.

4. The electrical contact arrangements as claimed in claim 3, characterized in that the bimetallic strip has steel on the inside, and has copper or a copper alloy on the outside.

5. The electrical contact arrangements as claimed in claim 1, characterized in that the two switching contacts of the electrical conductor loop and the switching contact of that electrical contact arrangement which is not connected to the electrical conductor loop are connected to arcing horns.

6. The electrical contact arrangements as claimed in claim 1, characterized in that the electrical conductor loop has mutually opposite switching contacts.

* * * * *